United States Patent [19]

Bly et al.

[11] 4,455,823

[45] Jun. 26, 1984

[54] DIESEL EXHAUST PARTICULATE TRAP WITH PLEATED FILTER

[75] Inventors: Kenneth B. Bly, Pontiac; Otto A. Ludecke, Rochester; Richard H. Smith, Birmingham, all of Mich.

[73] Assignee: General Motors Corporation, Detroit, Mich.

[21] Appl. No.: 435,419

[22] Filed: Oct. 20, 1982

[51] Int. Cl.[3] ..... F01N 3/02

[52] U.S. Cl. ..... 60/311; 55/215; 55/283; 55/497; 55/499; 55/500; 55/521; 55/523; 55/DIG. 30

[58] Field of Search ..... 60/311; 55/213, 215, 55/283, 497, 499, 500, 521, 523, DIG. 30

[56] References Cited

U.S. PATENT DOCUMENTS

| | | | |
|---|---|---|---|
| 3,244,315 | 8/1964 | Hunn | 55/500 |
| 3,937,015 | 2/1976 | Akado | 55/523 |
| 4,264,344 | 4/1981 | Luedecke | 60/311 |
| 4,283,207 | 8/1981 | Martyniuk | 55/521 |
| 4,343,149 | 8/1982 | Abtheff | 55/523 |
| 4,359,864 | 11/1982 | Bailey | 55/283 |

*Primary Examiner*—Douglas Hart

*Attorney, Agent, or Firm*—Arthur N. Krein

[57] ABSTRACT

A diesel exhaust particulate trap is provided with a heat resistant particulate filter which includes a perforated and pleated metal substrate member coated with a ceramic fiber filter material on its interior surface so as to define a filter chamber for the inside-out flow of exhaust gases through the filter. In a preferred embodiment, an electrical particulate filter igniter is associated with the filter. The igniter includes a trap door pivotably secured to the substrate member, which is normally biased to a closed position by a spring but which can be opened by exhaust flow prior to an accumulation of particulates on the filter. Opening and closing of the trap door is used to effect deenergization and energization, respectively, of an electrical heating element used to initiate combustion of particulates.

4 Claims, 7 Drawing Figures

DIESEL EXHAUST PARTICULATE TRAP WITH PLEATED FILTER

This invention relates to diesel engine exhaust particulate traps and, in particular, to a heat resistant particulate filter for use in such traps.

DESCRIPTION OF THE PRIOR ART

It is known in the art to provide a diesel engine with an exhaust treatment system for the removal of particulates from the exhaust flow discharged from the engine. In one type of system, a particulate trap, which includes a trap housing with a particulate filter therein, is used to filter out and collect particulates from the exhaust gas stream. Such particulates consist largely of carbon particles that tend to plug the filter, thus restricting exhaust gas flow therethrough. Accordingly, after continued use of such a filter for a period of time dependent on engine operation and, of course, the effective surface flow area of the filter, it becomes desirable to effect regeneration of the particulate filter.

Restoration or regeneration of such a particulate filter has been accomplished, for example, by the use of a suitable auxiliary heating device that is operative to heat the particulates so as to effect combustion thereof. For example, either an electrical heating element or a fuel burner with an air-fuel nozzle and associated ignition device can be used and operated, as desired, to heat at least a portion of the particulate filter to the combustion temperature of the collected particulates so as to burn them off the filter surfaces and, accordingly, to thus reopen the flow paths therethrough to again permit normal flow of the exhaust gases through the filter.

It is know to form particulate filters from commercially available high-temperature resistant ceramic fiber materials which, as shown, for example, In U.S. Pat. No. 4,283,207 entitled Diesel Exhaust Filter-Incinerator issued Aug. 11, 1981 to Ernest T. Martyniuk, can be preformed into a suitable filter configuration, as desired. However, the use of the known particulate filters made of such ceramic fiber materials has been somewhat restricted up to this point in time due to either the limited usable flow surface area of such known filters or to the limited structural integrity of such a known filter in operational use.

SUMMARY OF THE INVENTION

The present invention relates to a heat resistant particulate filter which includes a perforated and pleated metal substrate with a ceramic fiber filter material on one side thereof and, which is structurally arranged for the inside-out flow of exhaust gases so that, a large usable filter area is available and whereby during incineration of particulates trapped on the filter material, the heat generated thereby is substantially retained within the filter to assist in the propagation of a burning flame front across substantially the entire filter surface area of the filter.

Accordingly, a primary object of the invention is to provide an improved diesel exhaust particulate filter of heat resistant construction and which provides a large surface area for the collection of particulates from the exhaust gas discharged from a diesel engine.

Another object of the invention is to provide an improved diesel particulate filter for use in the trap housing of an exhaust cleaner system for a diesel engine, which filter is adapted for the inside-out flow of exhaust gases whereby such construction facilitates the incineration of particulates trapped by the filter.

For a better understanding of the invention, as well as other objects and further features thereof, reference is had to the following detailed description of the invention to be read in connection with the accompanying drawings.

DESCRIPTION OF A PREFERRED EMBODIMENT

Figure 1:
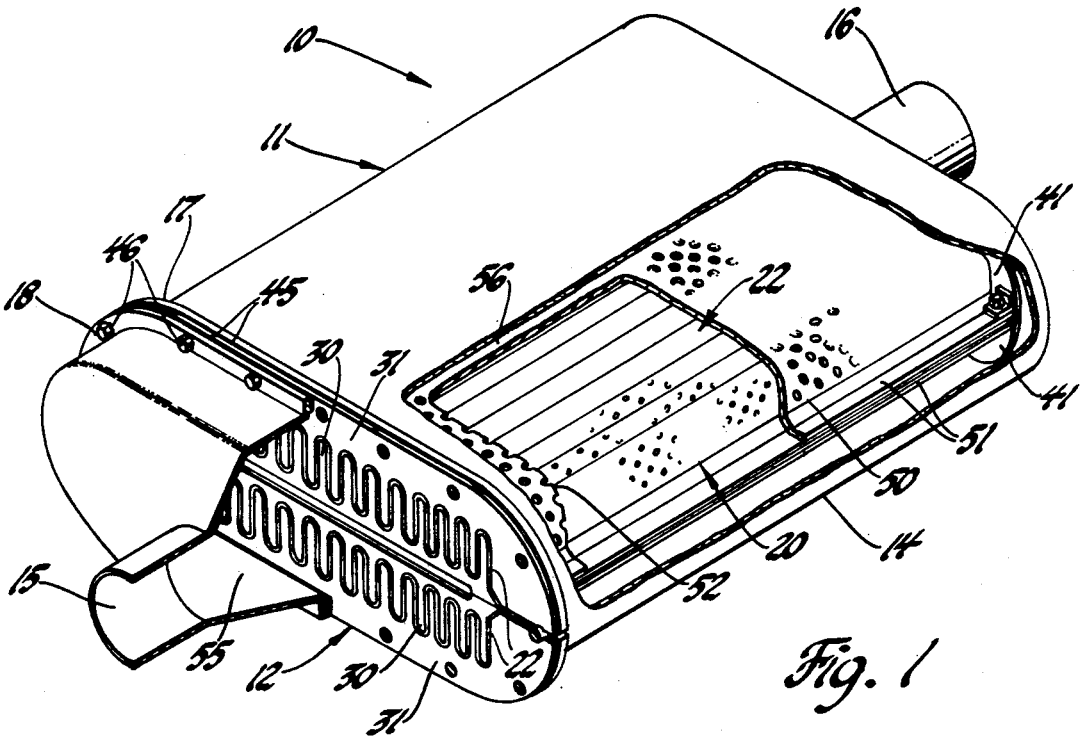
FIG. 1 is a pictorial view of a particulate trap with filter in accordance with the invention for use with a diesel engine, parts of the trap housing and filter being partially cut away to show structural details thereof.
Figure 2:
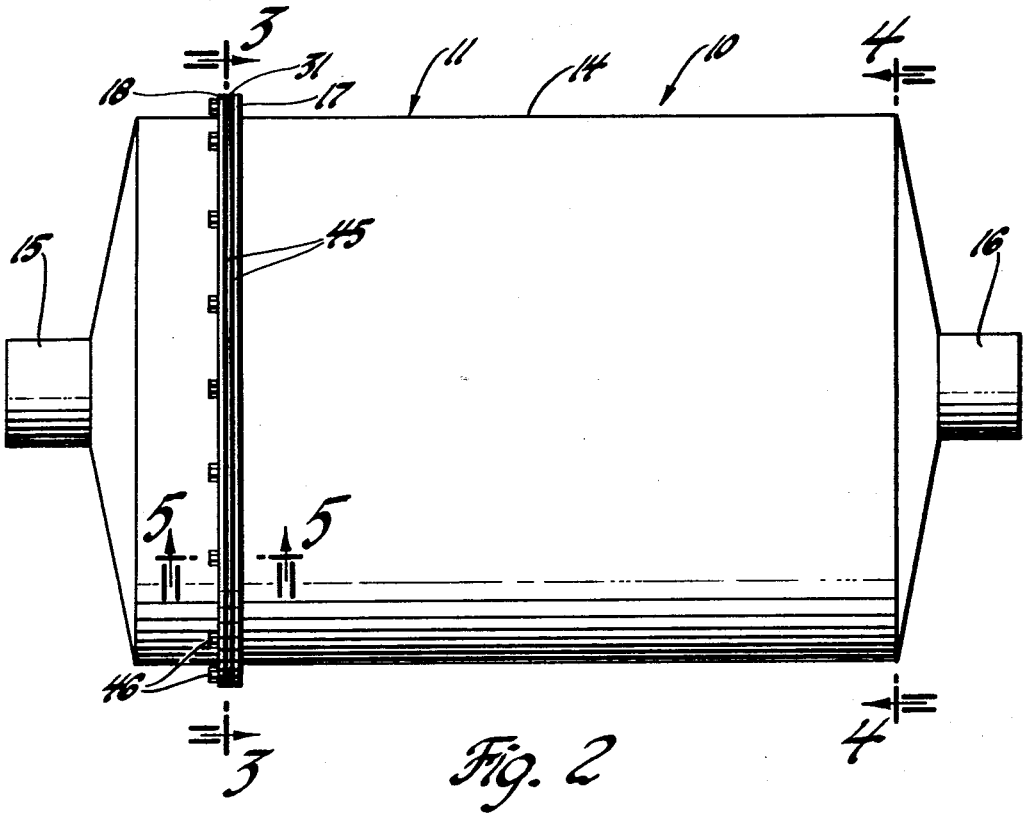
FIG. 2 is a top view of the particulate trap of FIG. 1.

Referring first to FIGS. 1 and 2, there is shown an exhaust treatment apparatus in the form of a particulate trap, generally designated 10, which is adapted to receive exahust gas discharged from a diesel engine, not shown. The filter trap 10, includes a trap housing 11 with a particulate filter 12, in accordance with the invention to be described in detail hereinafter, operatively supported therein.

The trap housing 11, as best seen in FIGS. 1 and 2, includes a tubular shell 14, preferably formed of sheet metal and having a generally elongated and flattened configuration, with an inlet connector 15 and an outlet connector 16 disposed at opposite ends thereof to provide means for connecting the filter trap in the exhaust system of a diesel engine powered vehicle and to provide for the passage of exhaust gases into and out of the trap housing 11.

Figure 5:
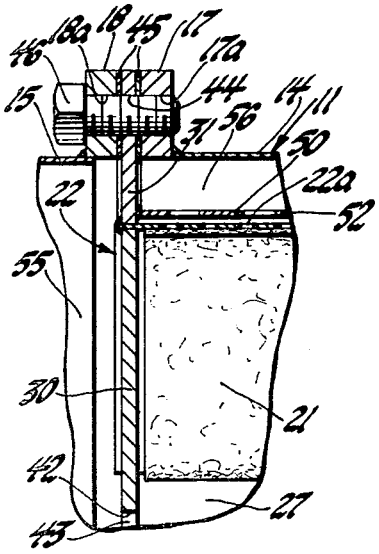
FIG. 5 is a sectional view of the particulate trap taken along lines 5—5 of FIG. 2 to show the assembly of a substrate member with its inner and outer end plates and to show the mounting assembly of the filter to the trap housing.

In the construction illustrated, the forward end of the shell 14 is provided with a radial outward extending flange 17 having a plurality of spaced apart internally threaded apertures 17*a*, FIG. 5, and, the outboard end of the inlet connector 15 is provided with a similar flange 18 having corresponding fastener receiving apertures 18*a*, whereby the inlet connector 15 and the particulate filter 12 can both be operatively connected to the shell 14, in a manner to be described in detail hereinafter.

The particulate filter 12, in accordance with the invention, includes an outer perforated and pleated, tubular substrate member 20, that defines an outer porous shell, of flattened configuration conforming to but of smaller size than shell 14, with a coating of a suitable ceramic fiber filter material 21 on its interior surface.

Figure 3:
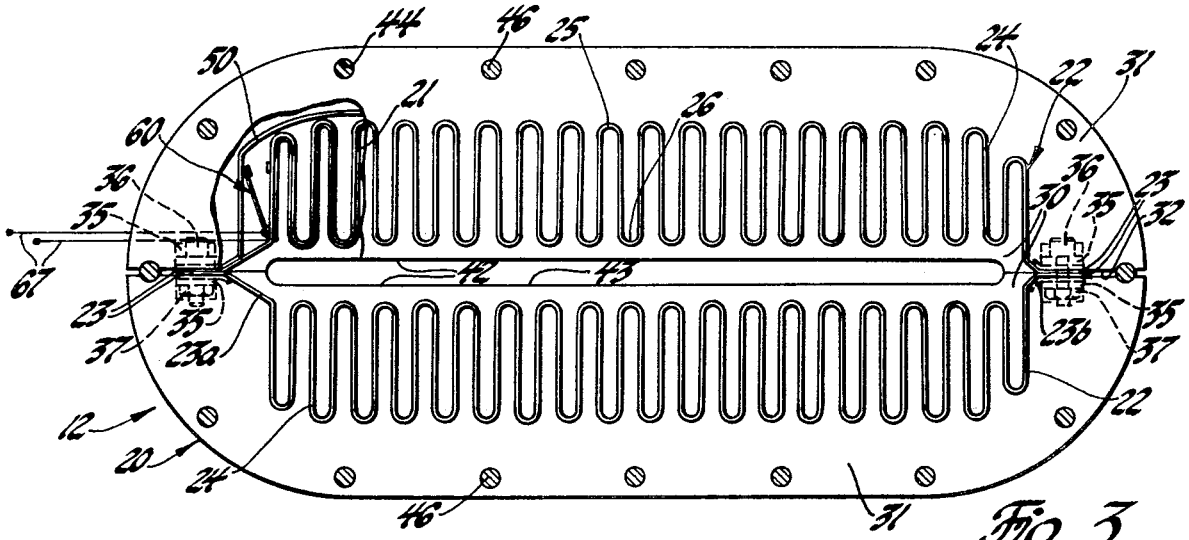
FIG. 3 is a sectional view of the upstream end of the particulate trap taken along lines 3—3 of FIG. 2, with parts broken away to show an electrical particulate filter igniter associated with the particulate filter.
Figure 4:
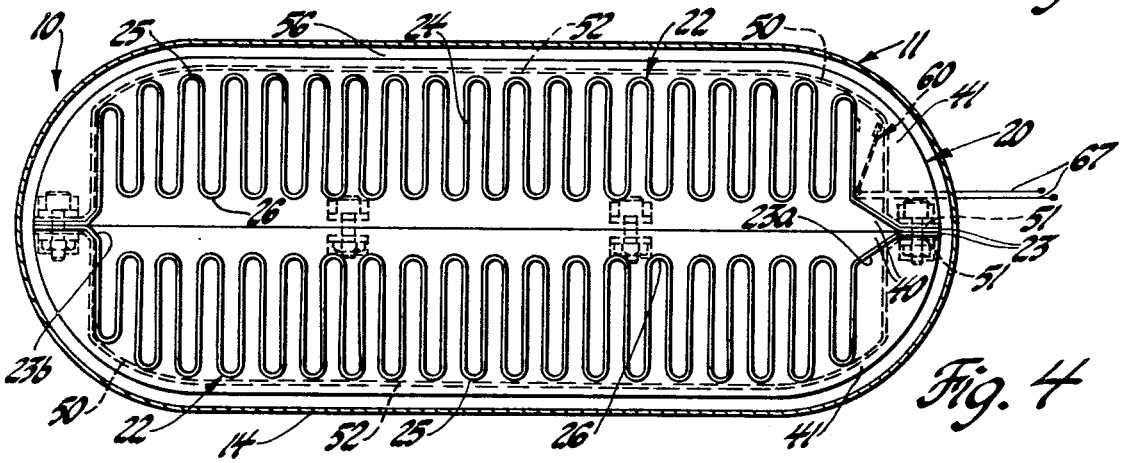
FIG. 4 is a sectional view of the downstream end of the particulate trap taken along lines 4—4 of FIG. 2.
Figure 7:
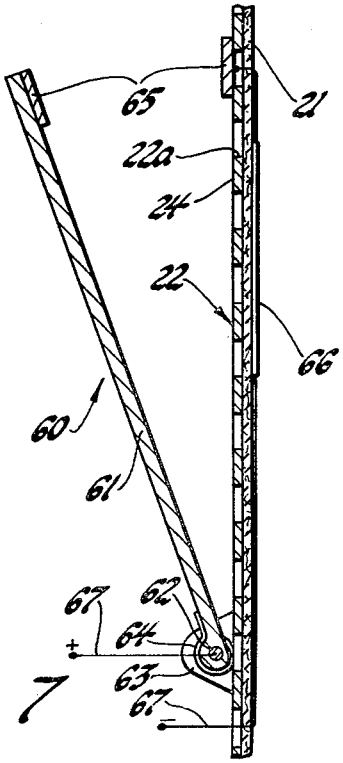

In the construction illustrated as best seen in FIGS. 3, 4 and 7, the substrate member 20 of the particulate filter 12, in order to facilitate its manufacture and assembly and, to facilitate the coating of the ceramic fiber filter material thereon, is formed so as to include a pair of complementary shaped substrate elements 22. Each substrate element 22, which may be formed of a metal screen material or, as shown, of a suitable medium or high temperature sheet metal that has adequate corrosion resistance, such as a low alloy or stainless steels, which is perforated with a large number of small openings 22*a* to permit gas flow therethrough.

Figure 6:
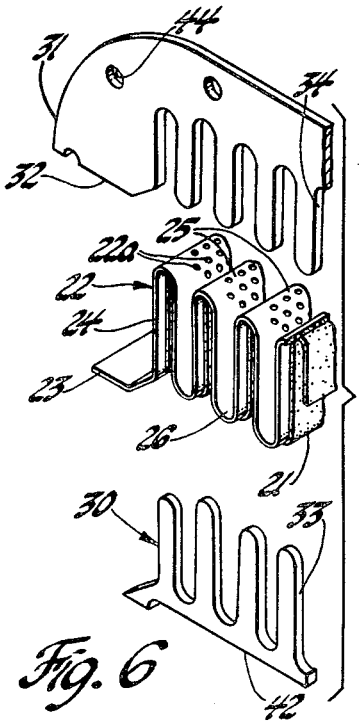
FIG. 6 is an exploded perspective view of a filter element and associated inner and outer end plates showing the mating relationship of these components; and, FIG. 7 is an enlarged sectional view of a portion of a filter element with an electrical particulate filter igniter associated therewith, the trap door of this unit being illustrated in an open position.

Each substrate member 22, as seen from an end thereof, such as shown in FIG. 3, is provided at each longitudinal extending side with a flat flange portion 23 and, intermediate these flange portions it is corrugated so as to provide pleats or corrugations 24, with the flange portions 23 being connected by inclined lead-in portions 23*a* and 23*b* to the corrugations, in the construction shown as best seen in FIGS. 3 and 4. As best seen in FIGS. 3, 4 and 6, the corrugations 24 are so formed that the peaks 25 of the ridges of the corrugations are located a substantial distance from the plane of the flange portions 23 while the valley 26 of each groove portion thereof is spaced a predetermined lesser distance in the same direction from the plane of the flange portions 23 as the peaks 25 whereby when the pair of substrate elements 22 are assembled together, as described hereinafter, in opposed relationship to each other with their flange portions in abutment against each other, they will define a hollow filter element with an internal cavity 27 therein. It should now be apparent that the pleats or corrugations 24 provide for a multifold increase in the surface area defining this filter element and the cavity 27 therein as compared to a substrate structure wherein the substrate elements were made, for example, with a flat planar configuration.

Still referring to the substrate elements 22, the inner surface of each, with reference to the cavity 27 defined by the surfaces of the substrate elements in their assembled configuration, as seen, for example, in FIGS. 3, 5 and 6, is provided with a coating of a commercially available high-temperature ceramic fiber filter material 21 of predetermined porosity that is suitable preferably for operation at temperatures of 1800° F. and above. Examples are fibers formed of equal amounts of aluminum and silicon oxides capable of temperatures up to 1800° F., fibers with 2% added boro-silica capable of temperatures to 2300° F. and 100% aluminum oxide fibers capable of operating at temperatures up to 3000° F.

In a particular application, the ceramic fiber filter material 21 was applied to the inner surface of each substrate element 22 while the corrugations 24 thereof were in a relaxed configuration, that is, with the corrugations slightly expanded relative to each other as compared to their as-assembled parallel relationship, shown in FIGS. 3 and 4. Thereafter, the corrugations were gathered together in parallel relationship to each other during their assembly to the associated inner and outer end plates to be described in detail hereinafter.

At its inboard end, the left hand end with reference to FIG. 1, each substrate element 22 has this end sealingly sandwiched between a pair of inner and outer inlet end plates 30 and 31, respectively. As best seen in FIGS. 3 and 6, each associated pair of end plates 30 and 31 are configured so that their opposed surfaces can have the inboard edge of an associated substrate member 22 sandwiched therebetween and these end plates are thus provided with complementary shaped mating surfaces, including a flange receiving portion 32 on the outer end plate 31 and corrugations 33 and 34 on the end plates 30, 31, respectively, so as to accommodate the flange portions 23, the lead-in portions 23*a* and 23*b* and to receive corrugations 24 of an associated substrate member 22.

The opposite outboard end, in terms of the general direction of exhaust flow through a trap, of each substrate member 22, that is, the right hand end with reference to FIG. 1 and as shown in FIG. 4, is similarly sandwiched between a pair of inner and outer end plates 40 and 41, respectively, having substrate member 22 engaging surfaces as described hereinabove relative to the inner and outer inlet end plates 30 and 31, respectively.

In the embodiment shown and as best seen in FIG. 3, the outer inlet end plates 31 are suitably provided with mounting brackets 35 having apertures extending therethrough whereby the two sets of the inner and outer inlet end plates 30 and 31 can be suitably secured together into a unitary inlet end plate structure as by threaded fastener means 36 and nuts 37. In a similar manner, the inner and outer end plates 40 and 41, respectively, are also provided with suitable mounting brackets 35 having apertures therethrough whereby the two sets of the inner and outer end plates 40 and 41 are secured together into a unitary end plates structure, as shown in FIG. 4.

As best seen in FIGS. 3, 5 and 6, each of the inner inlet end plates 30 is provided with a cutout portion 42 on the surface thereof opposite the notches 33 whereby when the two inner inlet end plates 30 are secured together, in a manner to be described in detail hereinafter, these cutout portions 42 define an exhaust inlet 43 for the flow of exhaust gases into the cavity 27.

The associate outer inlet end plates 31 each have their outer free ends shaped and sized so as to conform to the flanges 17 and 18 and these outer inlet end plates 31 are provided with properly located apertures 44 whereby the end plates 31 with suitable heat resistant gaskets 45 on the opposite sides thereof can be suitably secured in sandwiched relationship between the flange 17 of shell 14 and flange 18 of inlet 15, as by screws 46 in the manner best seen in FIG. 5. For this purpose, the apertures 44 in the flange 17 are internally threaded so as to threadingly receive the threads of the screws 46.

In contrast to the above, the outer end plates 41 each have their free outer peripheral surface configured and sized whereby these end plates are loosely received in the shell 14, as shown in FIG. 4, whereby to define an annular exhaust flow path between the outer peripheral surface of these end plates and the interior surface of shell 14.

Thus with the arrangement shown and described, the particulate filter 12 is adapted to be mounted in cantilever fashion by its inlet end plates 30, 31 to the inlet end of the trap housing shell 14 so that the main portion of the filter extends into the shell 14 in spaced apart relationship to the inner surface of this shell.

As should now be apparent, each of the substrate elements 22 is suitably fixed at one end to the associate inner and outer inlet end plates 30 and 31, respectively, and at their opposite end to the associate inner and outer end plates 40 and 41, respectively, and these substrate elements 22 are suitably interconnected at their flange portions 23 so as to prevent the non-filtered leakage of exhaust gases.

For this purpose, in the construction shown, during the process of coating the ceramic fiber filter material 21 on the substrate elements 22, none of this filter material was applied to opposite ends of each of the substrate elements 22 for a predetermined extent as best seen in FIG. 6. This thus permits welding of these ends of each substrate element to its associate inner and outer inlet end plates 30 and 31, respectively, as shown in FIG. 5, and the welding of its other end to its associate inner and outer end plates 40 and 41, respectively, in a similar manner. As best seen in FIG. 5, the edge portion of the substrate element 22 is preferably positioned so as to extend outboard of the associate end plates whereby to receive a continuous weld on opposite sides thereof to the end plates so as to effect a sealed connection between these elements.

The flange portions 23 are also kept free of the filter material 21 and, after the opposed sets of flange portions 23 of a pair of filter elements 22 are placed in abutment against each other, their edges can be secured together as by a continuous bead weld or, alternately, they can be coated with the ceramic fiber filter material and then sandwiched together between bar clamps so that the ceramic fiber filter material 21 on the flange portions is compressed together whereby to serve as a gasket-like seal.

Also in the construction shown and as best seen in FIGS. 1 and 4, a pair of support members 50, formed of a suitable perforated sheet metal, such as stainless steel, and each provided with side flanges 51 and an intermediate portion 52 conforming substantially to the major outer configuration of the substrate elements 22, are suitably secured in a suitable manner to the flange portions 23 of the substrate elements 22, whereby these support members provide a support envelope that encircles the substrate elements 22. For this purpose in the construction illustrated and as best seen in FIGS. 3 and 4, the side flanges are sandwiched between the outside sets of mounting brackets 35, the support members 50 being of a suitable extent to fit between the opposed sets of end plates.

It will now be apparent that with the particulate filter 12 mounted as described hereinabove to both the inlet connector 15 and shell 14 of the trap housing 11, the outboard surfaces of its inlet end plates 30, 31 will form with the inlet connector 15 an exhaust inlet chamber 55, see FIG. 5, with exhaust gas then flowing through the exhaust inlet 43 into the cavity 27, which, with the ceramic fiber filter material coated on the substrate elements 22, is actually a filter chamber. The exhaust gas then flows from the filter chamber or cavity 27 through the filter media 21 and through the apertures **22*a* in the substrate elements 22 into an exhaust passage 56, defined by the space between the interior surface of the shell 14 and the exterior of the substrate member 20, as seen in FIGS. 1, 4 and 5 for flow out through the outlet connector 16**.

During this inside-out flow of exhaust gases through the particulate filter 12, particulates will be filtered from the exhaust gases by the ceramic fiber filter material 21 with these particulates collecting thereon so that after a period of time it then becomes necessary to effect regeneration of the particulate filter as by the in-place incineration of the collected particulates.

In the preferred embodiment shown, and as best seen in FIGS. 3 and 7, this incineration is initiated by means of a particulate filter igniter, generally designated 60. In the construction shown, this igniter 60 includes a trap door 61 which has a pin 62 suitably fixed to one end thereof, the opposite ends of the pin 62 being pivotably mounted to a pair of aperture pivot support plates 63 secured, as by welding, to the exterior of a substrate element 22, as on an outboard corrugation 24 thereof as shown in FIGS. 3 and 7. A spring 64, of predetermined force, is operatively positioned to normally bias the trap door 61 in a pivotal direction whereby it will abut against the associate exterior surface of the associate substrate element 22.

At its opposite end, the trap door 61 has an electrical contact 65 fixed thereon in position to engage a similar contact 65 fixed to the substrate element 22, the latter being electrically connected to one end of an electrical heater element 66. As shown in FIG. 7, the heater element 66 is positioned to overlie the portion of the ceramic fiber filter material 21 on the portion of the substrate element 22 in the area over which the trap door is hinged. The opposite end of the heater element 66 and the contact 65 on the trap door 61 are connected by suitable electrical conductors 67 to a source of electrical power via the usual vehicle electrical ignition on-off switch, both not shown, suitable apertures, not shown, being provided for example in the shell 14 for the passage of the conductors.

During engine operation and with the filter material 21 clean, the flow of exhaust gas through the filter 12 will be sufficient so as to force open the trap door 61 to the position shown in FIGS. 3, 4 and 7, the bias force of spring 64 being preselected to permit this opening of the trap door by normal exhaust flow. In this open position of the trap door 61, the electrical contacts 65 are broken and the heater element 66 remains deenergized.

However, during engine operation, as the exhaust gases flow through the filter 12, particulates will be collected on the filter material 21 and, as the collection of particulates increases, they will effect a decrease in the differential pressure across the filter. Thus after a considerable build up of these collected particulates, the exhaust flow striking the downstream face of the trap door 61 will be reduced to the point at which the spring 64 will then be operative to effect closure of the trap door 61 whereby its electrical contact 65 engages the mating contact 65 to effect energization of the electrical heater element 66.

With the energization of the heater element 66, the collected particulates adjacent to or in contact therewith will be heated to their combustion temperature so that the particulates can begin to be incinerated. Since at that time, the trap door 61 is closed, the particulates can burn sufficiently whereby to initiate the propagation of a hot flame from this area across the entire surface area of the filter. This is due to the fact that the closed trap door 61 isolates the associated area of the filter from the cooling effect of exhaust flow through the filter until such time as sufficient incineration of the local particulates is affected to again allow exhaust flow to effect opening of the trap door. The time interval before this occurs is sufficient to allow a hot flame front to be established by these burning particulates in the area of the trap door.

It should now be appreciated with the inside-out flow type filter construction of the invention that the insulative effect of the ceramic fiber filter material 21 is operative to reduce the amount of energy required to raise the particulates to its ignition temperature. It also permits the particulate burning to propagate if spot ignition is initiated, as by the igniter 60 described hereinabove.

Although only one particulate filter igniter 60 is shown as operatively associated with only one of the substrate members 22, it will be apparent that such an igniter can be operatively associated with each of the substrate members.

Although a preferred embodiment of a particulates filter igniter has been disclosed as used with the subject particulate filter, it will be apparent to those skilled in the art that other means, such as a diesel fuel or propane burner, can be used to supply the heat necessary to raise the particulates to their combustion temperature.

Accordingly, while the invention has been described with reference to a particular embodiment disclosed herein, it is not confined to the details set forth since it is apparent that various modifications can be made by those skilled in the art without departing from the scope of the invention. For example, the substrate member could be of cylindrical bellows-type configuration with the ceramic fiber filter material then accreted or centrifugally deposited on the inside of the bellows. As another example, it should be apparent that the trap door 61 instead of being used to control energization of an electrical heating element, could be used, as with an electrical switch, to initiate operation of a burner, operate a bypass or to perform other functions dependent upon a filter particulate loading signal. This application is therefore intended to cover such modifications or changes as may come within the purposes of the invention as defined by the following claims.

The embodiments of the invention in which an exclusive property or privilege is claimed are defined as follows:

1. A diesel engine particulate filter trap comprising a trap housing having an exhaust inlet means at one end, an exhaust outlet means at the opposite end, and an interconnecting shell; and, a particulate filter means supported in said trap housing, said particulate filter means including spaced apart inboard and outboard plate means, with said inboard end plate means having a through inlet aperture therein, a perforated and corrugated, tubular metal substrate member means fixed at opposite ends to said inboard and outboard end plate means in position to encircle said inlet aperture whereby to define a chamber of corrugated-like configuration and, a ceramic fiber filter material fixed to the chamber surface side of said substrate member means; said inboard end plate means being secured between said exhaust inlet means and said shell for defining an exhaust inlet chamber with said exhaust inlet means, said filter means downstream in terms of exhaust flow from said inlet end plate means being thus supported in spaced apart relationship to said shell whereby to form with said shell a discharge passage means which is in flow communication with said exhaust outlet means, said particulate filter thus being operative for the inside-out flow of exhaust gases whereby exhaust gas flowing into said particulate filter will have particulates removed therefrom by said ceramic fiber filter material as the exhaust gas flow therethrough to said discharge passage means.

2. A diesel engine particulate filter trap comprising a trap housing having an exhaust inlet means at one end, an exhaust outlet means at the opposite end, and an intermediate interconnecting shell defining a compartment; and, a ceramic fiber coated, perforated and pleated metal filter means supported in said trap housing, said filter means including inlet end plate means, with an inlet aperture therein opening into the interior of said filter means, secured between said exhaust inlet means and said shell for defining an exhaust inlet chamber with said exhaust inlet means and for separating said exhaust inlet chamber from said compartment, said filter means downstream in terms of exhaust flow from said inlet end plate means being located in spaced apart relationship to said shell whereby to divide said compartment into a discharge passage means between the exterior of said filter means and said shell which is in flow communication with said exhaust outlet means and, a filter chamber within said filter means, said filter means being adapted for the inside-out flow of exhaust gases whereby exhaust gas flowing into said filter chamber will have particulates removed therefrom by said ceramic fiber as the exhaust gas flows from said filter chamber to said discharge passage means.

3. A diesel engine particulate filter trap comprising a trap housing having an exhaust inlet means at one end, an exhaust outlet means at the opposite end, an interconnecting shell defining a compartment, a filter means supported in said trap housing, said filter means including a pair of perforated and pleated metal support members fixed to each other at their longitudinal extending sides and being secured at one end to an inlet plate means with an inlet aperture therein and at their opposite end to an end plate means whereby to define a filter chamber, said support members having a ceramic fiber filter material fixed to the exposed filter chamber surfaces thereof, said inlet end plate means being secured between said exhaust inlet means and said shell for defining an exhaust inlet chamber with said exhaust inlet means and for separating said exhaust inlet chamber from said compartment, said filter means downstream in terms of exhaust flow from said inlet end plate means being located in spaced apart relationship to said shell whereby to divide said compartment into a discharge passage means between the exterior of said filter means and said shell which is in flow communication with said exhaust outlet means and said filter chamber within said filter means whereby exhaust gas flowing into said filter chamber will have particulates removed therefrom by said ceramic fiber filter material as the exhaust gas flows out from said filter chamber to said discharge passage means.

4. A particulate trap system for a diesel engine comprising a trap housing having an exhaust inlet and an exhaust outlet at opposite ends thereof, a particulate filter positioned in the trap housing for the inside-out flow of exhaust gases, said particulate filter including a perforated and corrugated substrate means defining a chamber and having a ceramic fiber filter material fixed to the chamber surface side of said substrate means whereby said filter is operative to remove the particulates from exhaust gas flowing therethrough; and, an electrical particulate filter igniter operatively associated with said particulate filter, said igniter including a door mounted adjacent to a portion of the substrate means on the outlet surface side thereof for pivotable movement toward and away from said outlet surface, a spring means operatively connected to said door to normally bias it in a direction for abutment against said outlet surface side portion of the substrate means, said spring being of a preselected bias force whereby exhaust flow through the particulate filter, when it is clean, will effect opening movement of the door but, as the back pressure builds up across the filter as a result of the particulates trapped thereon the reduced exhaust flow will allow the spring means to effect closing of said door; an electric heater element operatively associated with said filter material for supplying heat necessary for the incineration of particulates trapped on said filter material; and, an electric circuit means operatively connected to said electric heater element, including an electric switch means operatively associated with said door and said substrate means whereby when said door substantially engages said outlet surface of the substrate means said electric heater element will be energized and when said door is moved away by exhaust gas flow from the outlet surface of the substrate means said electric heater element will be deenergized.

* * * * *